United States Patent [19]

Yahata

[11] Patent Number: 4,761,804

[45] Date of Patent: Aug. 2, 1988

[54] HIGH DC VOLTAGE GENERATOR INCLUDING TRANSITION CHARACTERISTICS CORRECTING MEANS

[75] Inventor: Mitsuru Yahata, Ootawara, Japan

[73] Assignee: Kabushiki Kaisha Toshiba, Kawasaki, Japan

[21] Appl. No.: 66,020

[22] Filed: Jun. 24, 1987

[30] Foreign Application Priority Data

Jun. 25, 1986 [JP] Japan ..... 61-147149

[51] Int. Cl.[4] ..... H05G 1/32; H05G 1/34

[52] U.S. Cl. ..... 378/109; 378/111

[58] Field of Search ..... 378/101, 105, 106, 109, 378/110, 111, 112

[56] References Cited

U.S. PATENT DOCUMENTS

| | | | |
|---|---|---|---|
| 4,200,795 | 4/1980 | Kawamura et al. | 378/106 |
| 4,573,184 | 2/1986 | Tanaka et al. | 378/110 |
| 4,614,999 | 9/1986 | Onodera et al. | 378/106 X |

*Primary Examiner*—Eugene R. Laroche
*Assistant Examiner*—David Mis
*Attorney, Agent, or Firm*—Cushman, Darby & Cushman

[57] ABSTRACT

A high DC voltage generator for an X-ray tube includes a low voltage rectifier for rectifying a low AC input voltage to produce a low DC voltage, a DC-to-DC converter for converting the low DC voltage into a high DC voltage for the X-ray tube, and a controller for controlling transition characteristics of turning-on and off the X-ray tube. The controller shortens a rising time period of the high DC voltage until a rating anode voltage is applied to the X-ray tube after turn-on operation.

7 Claims, 4 Drawing Sheets

HIGH DC VOLTAGE GENERATOR INCLUDING TRANSITION CHARACTERISTICS CORRECTING MEANS

BACKGROUND OF THE INVENTION

1. Field of the Invention

The present invention generally relates to an apparatus for generating a high DC voltage to be applied to an X-ray tube, and more particularly, to a high DC voltage generator employing a controller for controlling turn-on/off transition characteristics of a high DC voltage and electric current.

2. Description of the Related Art

High DC voltage-generating apparatuses of this type, for use in an X-ray tube, are known. These conventional high DC voltage generators are disclosed in, for instance, U.S. Pat. Nos. 4,200,795 and 4,573,184.

Referring now to FIGS. 1 and 2, a conventional high DC voltage generator will be described in detail. In the circuit arrangement shown in FIG. 1, three-phase rectifier bridge circuit 1 is connected to receive a low three-phase AC voltage. The DC output of rectifier bridge circuit 1 is supplied to chopper circuit 2. Chopper circuit 2 controls its output voltage. The output of chopper circuit 2 is input to DC-to-AC inverter circuit 4 via filtering circuit 3. The output of inverter circuit 4, i.e., a low AC voltage, is stepped up by high-voltage transformer 5. The high AC voltage boosted by transformer 5 is rectified by high-voltage rectifier bridge circuit 6, smoothed by capacitors C1 and C2, and applied between the anode and filament (i.e., cathode) of X-ray tube 7.

In general, the high DC voltage generator shown in FIG. 1 is designed for use in the X-ray apparatus incorporated in a computerized tomography apparatus. Capacitors C1 and C2 are inserted in the secondary circuit of transformer 5 in order to reduce the ripple components in the high DC voltage (i.e., tube voltage) applied to X-ray tube 7. As is shown in FIG. 2, the turn-on and turn-off transition periods of tube voltage kV become inherently long, due to the existence of the capacitances of capacitors C1 and C2 and, in particular the impedance of the secondary circuit of transformer 5. In FIG. 2, "mA" represents the current flowing through X-ray tube 7 (hereinafter called "tube current"), and "If" denotes the filament current of X-ray tube 7.

Such an X-ray apparatus must be operated not to generate unnecessary X-rays which will not contribute to X-ray image data acquisition, or must be provided with an X-ray shutter for preventing such unnecessary X-rays from penetrating through a patient. Moreover, the X-ray apparatus exhibits a poor repetitive response due to the inherent lengthy turn-on (rising) and turn-off (falling) transition periods, and inevitably emits X-rays which do not contribute to image data acquisition. Further, the X-ray tube is subjected to unwanted thermal input during the rising transition period, and thus cannot operate at a high efficiency.

In summary, when an X-ray tube is driven by the output DC voltage of the conventional high DC voltage-generating apparatus, it exhibits poor repetitive response, emits a large quantity of unnecessary X-rays, and cannot operate at a high efficiency.

SUMMARY OF THE INVENTION

It is therefore an object of the present invention to provide an apparatus for generating a high DC voltage which drives an X-ray tube such that the X-ray tube emits a relatively small amount of X-rays, has a good repetitive response, and operates at a high efficiency.

The object and features of the present invention are accomplished by providing a high DC voltage generating apparatus for an X-ray tube comprising a low voltage rectifier for rectifying a low AC input voltage to produce a low DC voltage, a DC-to-DC converter for converting the low DC voltage into a high DC voltage, and, a controller for shortening a rising time period of the high DC voltage to be applied to the X-ray tube in response to an X-ray projection control signal, this rising time period being defined by a time period measured from a turn-on voltage of the X-ray tube to a predetermined anode voltage thereof.

The apparatus of this invention can generate a high DC voltage which drives an X-ray tube such that the X-ray tube emits a relatively small amount of X-rays, exhibits good repetitive response, and operates at a high efficiency.

BRIEF DESCRIPTION OF THE DRAWINGS

For a better understanding of the above-described object of the invention, reference will be made to the following detailed description of the invention to be read in conjunction with the accompanying drawings, in which.

DETAILED DESCRIPTION OF THE PREFERRED EMBODIMENTS

Basic Idea

Before describing various preferred embodiments of the present invention, the basic idea of the invention will be summarized.

The basic idea of the invention resides in the use of waveform control means for controlling the waveform, or more precisely, the transition characteristic, of a tube voltage, in response to an X-ray projection signal. More specifically, the invention is characterized in that the turn-on and turn-off transition periods of the tube voltage are shortened as much as possible thereby to make an X-ray tube emit as less harmful X-rays which do not contribute to the acquisition of X-ray image data. To this end, the rising and falling transition characteristics, or time periods of the tube current are controlled such that the tube current is as small as possible during the turn-on transition period, and/or as great as possible during the turn-off transition period.

The waveform control means, or a filament current control circuit, which is used to achieve the object, will now be described more in detail.

Arrangement of High DC Voltage Generator

Figure 3:
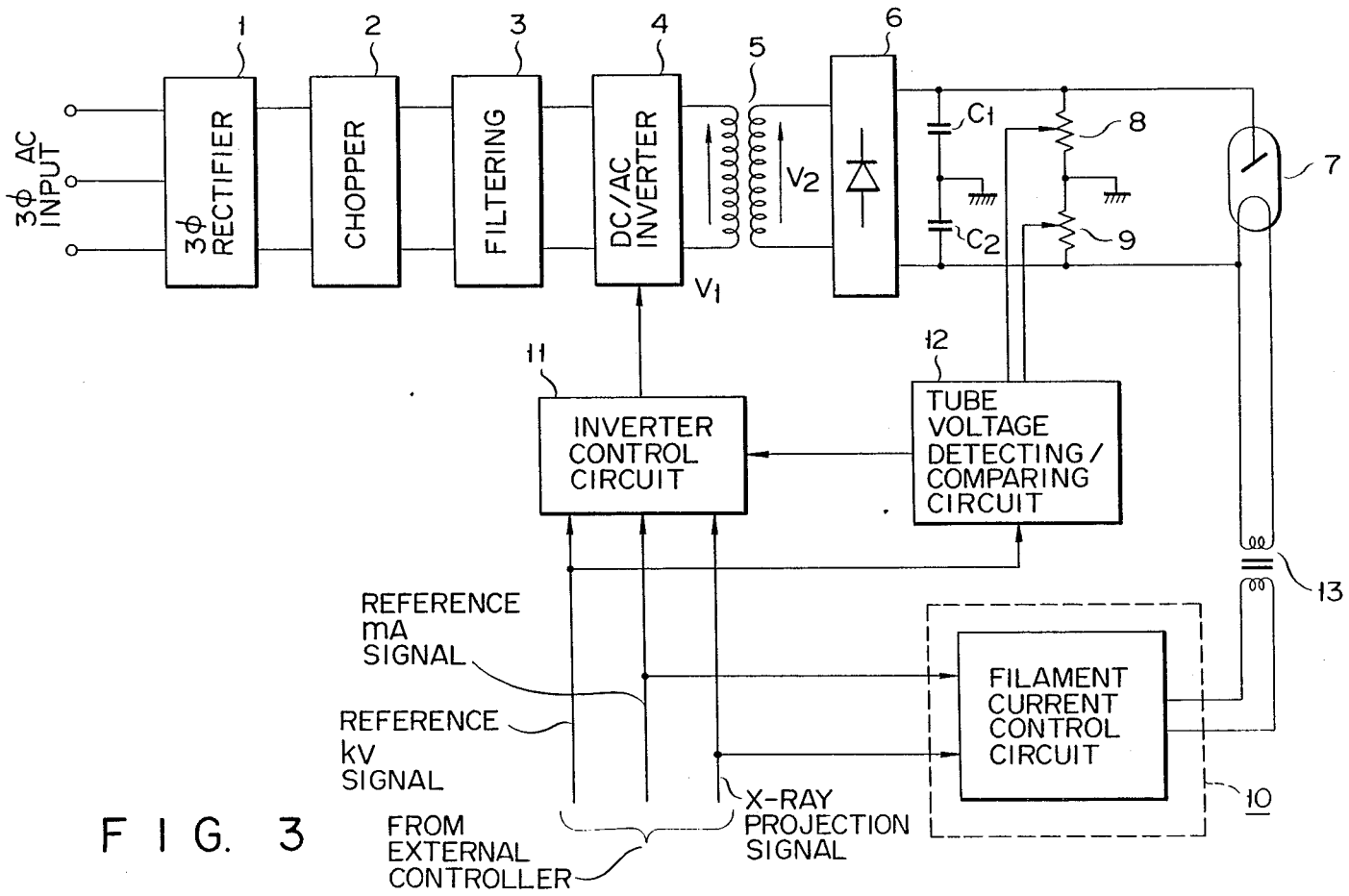
FIG. 3 is a schematic block diagram of a high DC voltage generator according to one preferred embodiment of the invention.

FIG. 3 is a schematic block diagram illustrating a high DC voltage generator, i.e., a first preferred embodiment of the present invention. In this drawing, the same numerals are used, designating the same components as those shown in FIG. 1.

In brief, this high DC voltage generator is different from the conventional one (see FIG. 1) in that it has variable resistors 8 and 9, filament current control circuit 10, inverter control circuit 11 and tube-voltage detecting/comparing circuit 12.

Variable resistors 8 and 9 are connected in series, thus forming a series circuit coupled to the output lines of high-voltage rectifier bridge circuit 6. This series-connected resistors 8 and 9 are also connected parallel to the series-connected capacitors C1 and C2. The node of variable resistors 8 and 9 is grounded. A positive voltage and a negative voltage, both based on the ground potential as a reference, appear from variable resistors 8 and 9, respectively. In other words, the series circuit constructed of resistors 8 and 9 subdivides the output voltage of high voltage rectifier circuit 6 into two voltages. These subdivided voltages are applied to tube-voltage detecting/comparing circuit 12. This circuit 12 compares these voltages, on the one hand, with the reference tube voltage (kV) signal supplied from an external controller (not shown).

Inverter control circuit 11 is so designed as to control the switching operation of inverter circuit 4, in response to the reference tube voltage (kV) signal, the reference tube current (mA) signal and the X-ray projection signal, which have been externally supplied. Inverter control circuit 11 also controls the feedback of the tube voltage in accordance with the output of tube voltage detecting/comparing circuit 12.

Waveform Control Means

The reference tube current (mA) signal and the X-ray projection signal are supplied from an external control means (not shown in detail) to filament current control circuit 10. In response to these input signals, filament current control circuit 10 controls filament transformer 13, thereby controlling the filament current flowing through X-ray tube 7. As the filament current is thus controlled, the tube current of X-ray tube 7 will be controlled as will be later explained. In the present embodiment, the filament current is controlled in accordance with the X-ray projection signal, thereby controlling the rising and falling transition characteristics, or time periods of the tube voltage. The X-ray projection signal is to turn on/off the emission of the X-rays from X-ray tube 7. More specifically, filament current control circuit 10 reduces the tube current at the start of X-ray projection, thus shortening the turn-on transition time period of X-ray tube 7, and increases the tube current at the end of X-ray projection, thereby shortening the turn-off transition time period of X-ray tube 7. In view of this specific function, filament current control circuit 10 is called "tube-voltage waveform control means" in this specification.

Operation of the High DC Voltage Generator

The overall operation of the high DC voltage generator of the present invention will now be described with reference to FIG. 3 and also to the waveform chart of FIGS. 4A to 4C.

The reference tube voltage signal and the reference tube current signal, both supplied from the external controller, set the normal tube voltage and the normal tube current in inverter control circuit 11. As previously described, the X-ray projection signal performs the on/off control of X-ray tube 7. More specifically, inverter circuit 4 under the control of inverter control circuit 11 applies primary voltage V1 to the primary winding of high-voltage transformer 5. Secondary high voltage V2 is thereby induced in the secondary winding of high-voltage transformer 5. Secondary voltage V2 is rectified by high-voltage rectifier bridge circuit 6, then smoothed by capacitors C1 and C2, and finally applied between the anode and cathode of X-ray tube 7. Driven by this voltage V2, X-ray tube 7 emits X-rays. The operation described in the preceding paragraph is identical to the one performed in the conventional high DC voltage generator. The high DC voltage generator of the present invention is characterized by the setup of controlling the waveforms of the tube voltage and tube current, which will be explained below.

Waveform Controlling

As has been stated in Basic Idea, filament current "If" is controlled thereby to control the waveforms of tube voltage (kV) and tube current (mA) during the turn-on and turn-off transition time periods ($t_{V3}$, $t_{V4}$; $t_{I3}$, $t_{I4}$). More precisely, at the start of X-ray projection, filament current control circuit 10 sets filament current "If" to a controlled value less than the normal value, thereby reducing the tube current to half the normal value (see FIGS. 2, 4B, 4C). As a result, the impedance drop in the secondary winding of high-voltage transformer 5 decreases. Secondary voltage V2 of transformer 5 therefore rises, whereby capacitors C1 and C2 are charged at high speed, thus shortening the rising transition time period $t_{V3}$ of the tube voltage (see FIGS. 2 and 4A).

Figure 5:
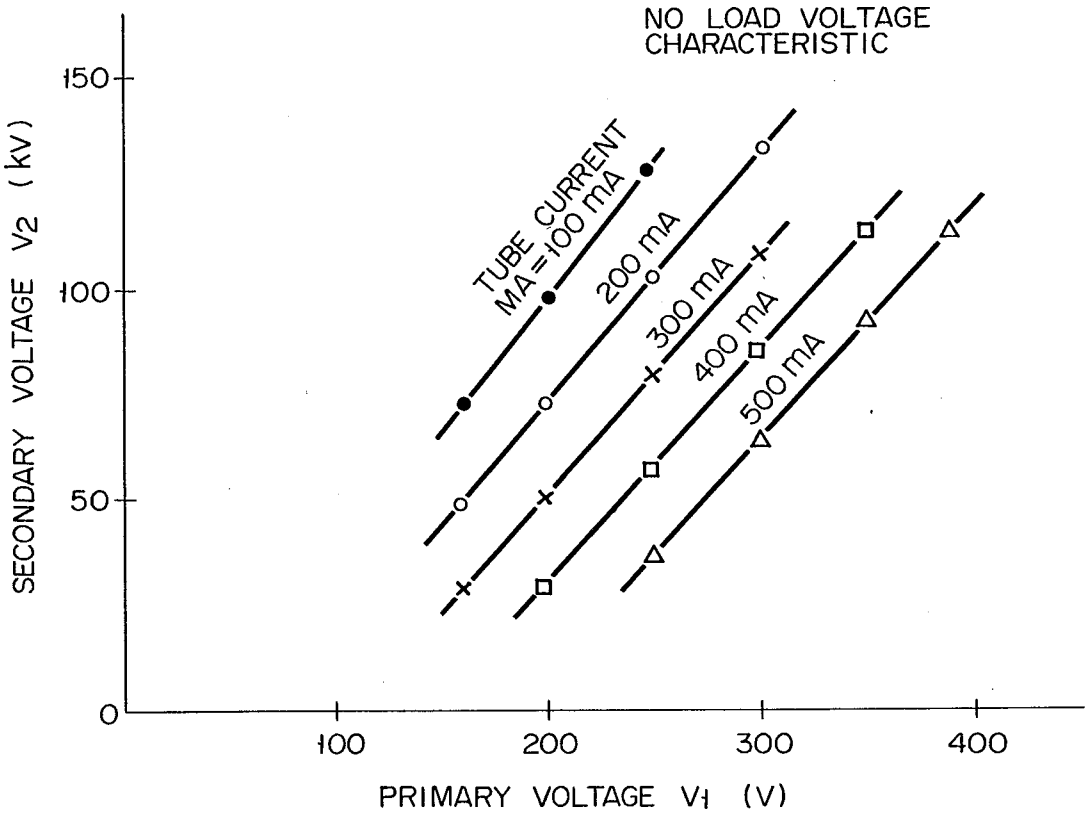
FIG. 5 is a graphic representation of the no-load voltage characteristics of the high-voltage transformer employed in the voltage generator shown in FIG. 3.

FIG. 5 shows the relationship between primary and secondary voltages V1 and V2 (peak value) under no load condition. In this graphic representation, the tube current is used as a parameter.

Figure 1:
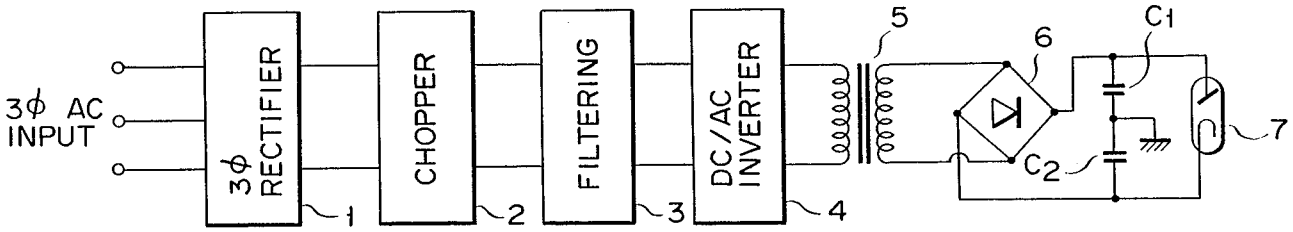
FIG. 1 (PRIOR ART)
FIG. 1 is a schematic block diagram of a conventional high DC voltage generator.
Figure 2:
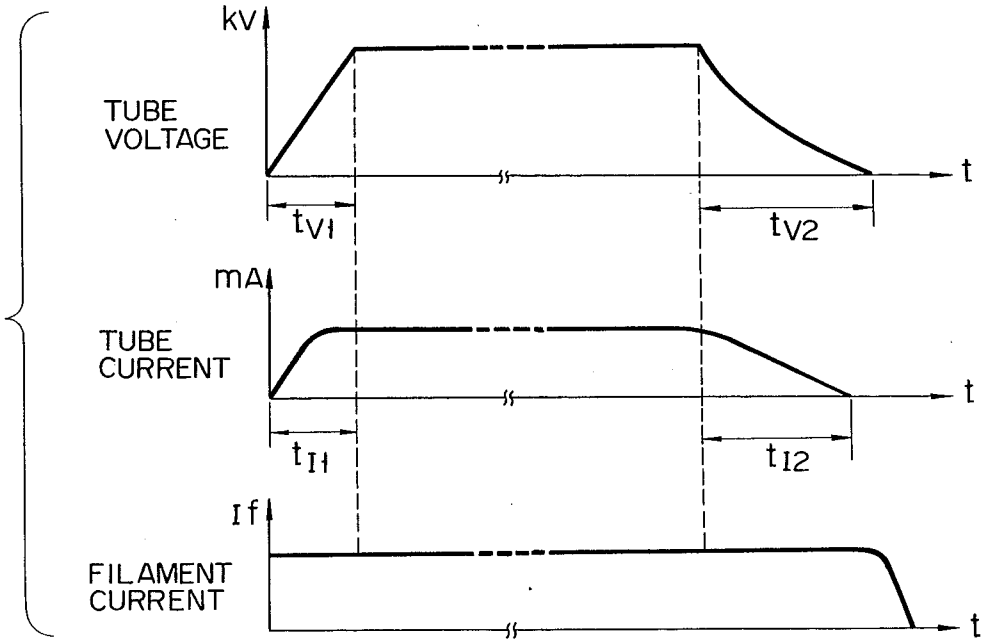
FIG. 2 shows the waveforms of the tube voltage, tube current and filament current, all generated by the voltage generator illustrated in FIG. 1.
Figures 4A, 4B, 4C, 6:
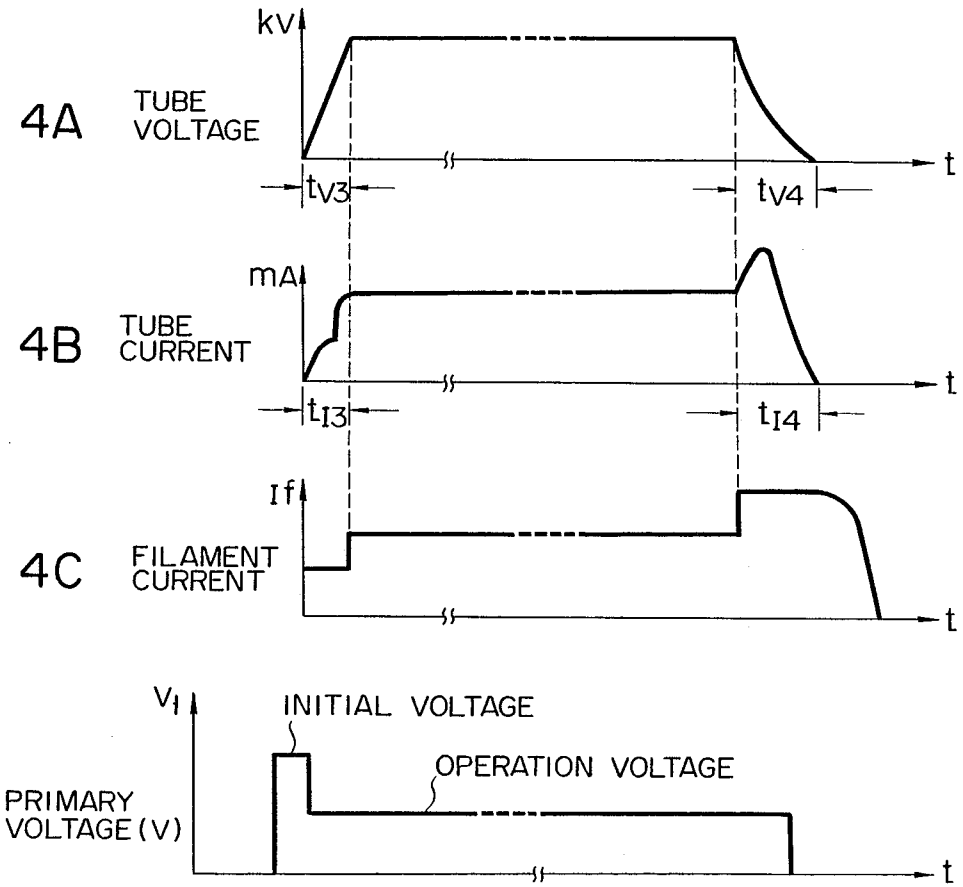
FIGS. 4A to 4C illustrate the waveforms the tube voltage, tube current and filament current generated by the voltage generator shown in FIG. 3.
FIG. 6 represents the waveform of primary voltage V1 of the high-voltage transformer used in another preferred embodiment of the invention.

As is easily seen from FIG. 2 and FIGS. 4A and 4B, the turn-on transition period $t_{V3}$ of the tube voltage is shorter than turn-on transition period $t_{V1}$ of the tube voltage generated by the conventional high DC voltage generator (FIG. 1), and similarly the turn-off transition period $t_{I4}$ of the tube current is shorter than turn-off transition period $t_{I2}$ of the tube current generated by the conventional high DC voltage generator (FIG. 1). That is, $t_{V3} < t_{V1}$, and $t_{I4} < t_{I2}$. In other words, not only the tube current is reduced, but also the turn-on and turn-off transition periods of the tube voltage and current are shortened, thereby suppressing, as much as possible, the emission of X-rays which do not contribute to the acquisition of X-ray image data.

In the case of ordinary continuous X-ray projection, the rising time period $t_{V1}$ is 1 to 5 seconds. The present invention can reduce this period to about 0.5 to 2 seconds.

As has been described in detail, according to the present invention, filament current control circuit 10, which serves as a waveform control means, controls the tube current at the start and end of the X-ray projection, thereby improving the waveform of the tube voltage, more precisely, shortening the turn-on and turn-off transition periods of the tube voltage. Since these transition periods are shortened, the amount of unnecessary X-rays not contributing to the acquisition of X-ray image data can be considerably reduced, and the X-ray dose applied to a patient can be also reduced. For the same reason, the repetitive response characteristic of the X-ray tube can be improved. Further, for the same reason, the unnecessary thermal input to the X-ray can be reduced, resulting in the higher efficiency of the the X-ray tube.

Modification

The present invention is not limited to the embodiment described above. Various changes and modifications can be made without departing from the spirit and scope of the invention.

In the embodiment shown in FIG. 3, filament current control circuit 10 shortens both the rising and falling time periods of the tube voltage. Alternatively, control circuit 10 can be used to shorten only one of these time periods in order to achieve the object of the invention.

Furthermore, inverter control circuit 11 may be used, instead of filament control circuit 10, to increase primary voltage V1 of high-voltage transformer 5 higher than the normal primary voltage for X-ray projection, at the start of the X-ray projection as is shown in FIG. 6.

The embodiment described above is used in the X-ray apparatus wherein inverter 11 coupled to the primary winding of transformer 5 is switched. Nonetheless, it may also be used in an X-ray apparatus of a tetrode-switching type, wherein the tube voltage rises and falls slowly due to existence of a capacitance component (including stray capacitance), if any, between the tetrode and the X-ray tube. When the embodiment is incorporated in the X-ray apparatus of this type, it can solve the same problems resulting from the slow rising and falling periods of the tube voltage.

What is claimed is:

1. A high DC voltage generating apparatus for an X-ray tube comprising:

low voltage rectifier means for rectifying a low AC (alternating current) input voltage to produce a low DC (direct current) voltage;

DC-to-DC converting means for converting said low DC voltage into a high DC voltage; and, control means for shortening a rising time period of said high DC voltage to be applied to said X-ray tube in response to an X-ray projection control signal, said rising time period being defined by a time period measured from a turn-on voltage of said X-ray tube to a predetermined anode voltage thereof.

2. An apparatus as claimed in claim 1, wherein said control means includes:

a filament-current control circuit coupled to a filament circuit of said X-ray tube for reducing given filament current which flows during a normal tube operation for a predetermined time period within said rising time period, thereby lowering predetermined anode current flowing through said X-ray tube during a normal tube operation.

3. An apparatus as claimed in claim 2, wherein said filament-current control circuit reduces said given filament current so as to decrease said predetermined anode current approximately two times lower than said predetermined anode current.

4. A high DC voltage generating apparatus for an X-ray tube comprising:

low voltage rectifier means for rectifying a low AC (alternating current) input voltage to produce a low DC (direct current) voltage;

DC-to-DC converting means for converting said low DC voltage into a high DC voltage; and, control means for shortening a falling time period of said high DC voltage to be applied to said X-ray tube in response to an X-ray projection control signal, said falling time period being defined by a time period measured from a predetermined anode voltage of said X-ray tube to a near zero anode voltage thereof.

5. An apparatus as claimed in claim 4, wherein said control means includes:

a filament-current control circuit coupled to a filament circuit of said X-ray tube for increasing given filament current which flows during a normal tube operation for a predetermined time period within said falling time period, thereby increasing predetermined anode current flowing through said X-ray tube during a normal tube operation.

6. An apparatus as claimed in claim 4, wherein said filament-current control circuit increases said given filament current so as to increase said predetermined anode current approximately two times higher than said predetermined anode current.

7. An apparatus as claimed in claim 4, wherein said converting means includes:

a DC-to-AC inverter for inverting said low DC voltage into a pulsating low voltage, and an inverter controller for controlling said DC-to-AC inverter to increase said pulsating low voltage during said rising time period only, thereby applying an X-ray anode voltage higher than said predetermined anode voltage thereof to said X-ray tube.

* * * * *